United States Patent [19]

Glomski et al.

[11] 4,303,005

[45] Dec. 1, 1981

[54] HYDRAULIC CYLINDER ASSEMBLY

[75] Inventors: Norman J. Glomski, New Berlin; Buddy C. Schelman, West Allis, both of Wis.

[73] Assignee: The Heil Company, Milwaukee, Wis.

[21] Appl. No.: 57,943

[22] Filed: Jul. 16, 1979

[51] Int. Cl.[3] ..... F01B 7/20

[52] U.S. Cl. ..... 92/52; 29/156.4 R; 92/53; 92/260; 228/113

[58] Field of Search ..... 92/52, 53, 51, 85, 118, 92/231, 260, 128; 29/156.4 R; 91/408; 228/113

[56] References Cited

U.S. PATENT DOCUMENTS

| | | | |
|---|---|---|---|
| 2,364,741 | 12/1944 | Merchant | 92/53 X |
| 2,800,234 | 7/1957 | Herpich et al. | 92/53 X |
| 3,485,143 | 12/1969 | Canady | 228/113 X |
| 3,596,570 | 8/1971 | Kenyon | 92/260 |
| 3,934,423 | 1/1976 | Haller | 92/53 X |
| 4,089,251 | 5/1978 | Louviot | 91/408 X |

FOREIGN PATENT DOCUMENTS

| | | | |
|---|---|---|---|
| 219001 | 11/1968 | Australia | 92/53 |
| 74989 | 4/1949 | Norway | 92/53 |
| 771282 | 3/1957 | United Kingdom | 92/53 |

*Primary Examiner*—Irwin C. Cohen

*Attorney, Agent, or Firm*—Michael, Best & Friedrich

[57] ABSTRACT

A hydraulic cylinder assembly including an outer barrel having one or more internal sleeves and a center rod telescopically mounted therein. The outer barrel and internal sleeves each have a bottom end tube welded to one end thereof and a packing gland tube welded to the other end thereof. The center rod has a bottom end tube welded to one end thereof. The bottom end tubes on said barrel and sleeves have end caps removably mounted therein. Stop shoulders are formed integrally with the end tubes of the internal sleeves and center rod. Mating stop shoulders are formed integrally with the packing gland tubes of the outer barrel and internal sleeves. Said stop shoulders are adapted to move into engagement with each other when the hydraulic cylinder assembly is energized.

4 Claims, 2 Drawing Figures

HYDRAULIC CYLINDER ASSEMBLY

BACKGROUND OF THE INVENTION

I. Field of the Invention

This invention relates to a hydraulic cylinder assembly of the type used for raising and lowering the body of a dump truck for example.

II. Description of the Prior Art

One of the objects of the present invention is to provide a hydraulic cylinder assembly which can be easily disassembled and reassembled for purposes of maintenance and repair. Another important object is to provide such an assembly which includes an improved stop means between the telescopically arranged parts to provide a relatively large stop contact area and further provide a self-aligning seating condition at the mating surfaces of the stop shoulders.

SUMMARY OF THE INVENTION

A hydraulic cylinder assembly including an outer barrel comprising a tubular wall member having a bottom end tube welded to one end thereof and a packing gland tube welded to the other end thereof. An internal sleeve is telescopically mounted in the outer barrel which sleeve is comprised of a tubular wall member having a bottom end tube welded to one end thereof and a packing gland tube welded to the other end thereof. Said bottom end tubes of said barrel and sleeves each have an end cap removably mounted therein. A center rod is telescopically mounted in the internal sleeve and is comprised of a tubular wall member having a bottom end tube welded to one end thereof. Adjustable packing gland nuts are threadably mounted on the packing gland tubes of the outer barrel and internal sleeve. A first stop shoulder means is formed integrally with the end tubes of the internal sleeve and center rod. A second stop shoulder means is formed integrally with the packing gland tubes of the outer barrel and internal sleeve. The first and second stop shoulders are adapted to move into engagement with each other when the hydraulic cylinder assembly is energized.

DESCRIPTION OF THE PREFERRED EMBODIMENT

Figures 1, 2:
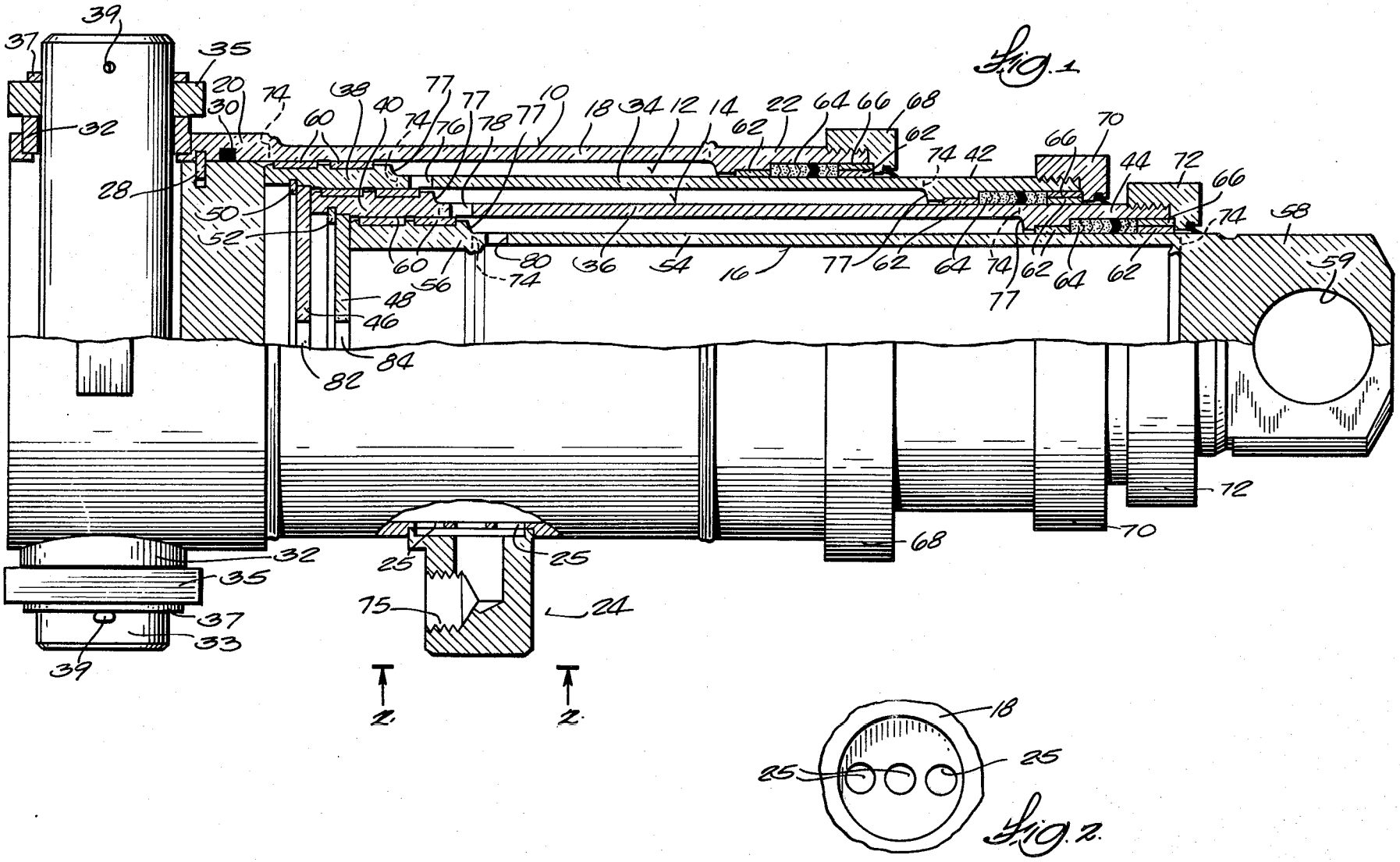
FIG. 1 is a partially sectioned side elevation view of the cylinder assembly of the present invention.
FIG. 2 is a view taken along 2—2 of FIG. 1 showing the outer barrel of the cylinder assembly before the inlet fitting 24 is welded thereto.

Referring to the drawings, the cylinder assembly of the present invention is comprised of an outer barrel 10 having internal sleeves 12, 14 and a center rod assembly 16 telescopically mounted therein.

Outer barrel 10 is comprised of a tubular wall member 18 having a bottom end tube 20 welded to one end thereof and a packing gland tube member 22 welded to the other end thereof.

An inlet fitting 24 is mounted by welding in the wall of tubular member 18 which fitting together with the multiple inlet openings 25 in the wall of member 18 have particular structural and functional characteristics which will be described in detail hereinafter.

An end cap 26 is removably mounted in end tube member 20 by means of a retaining ring 28 and is sealed in the end tube by means of an O-ring member 30.

A pair of axially aligned bearing sleeves, 32,32 are mounted in the wall of end tube 20 through which a suitable connector pin 33 can be inserted for securing the bottom end of the cylinder assembly to the particular device in which it is to be used. Pin 33 is secured in bearing sleeves 32,32 by any suitable means such as plates 35, washers 37 and cotter pins (not shown) mounted in pin openings 39. Plates 35 are made a part of the frame structure in which the cylinder assembly is mounted.

Internal sleeves 12 and 14 are of similar construction and include tubular wall members 34, 36, and bottom end tube members 38, 40 and packing gland tube members 42, 44 butt welded to opposite ends of the wall members.

The bottom end tube members 38, 40 of sleeves 12, 14 have end caps 46, 48 removably mounted therein by means of retaining rings 50, 52.

Rod assembly 16 is comprised of a tubular wall member 54 having a bottom end tube member 56 and a connection member 58 butt welded to opposite ends thereof. An opening 59 in the connection member 58 is provided for facilitating connection of the rod assembly 16 to the device in which the cylinder is to be used.

The end tubes 38, 40 and 56 welded to the ends of sleeve wall members 34, 36 and rod wall member 54, respectively, are provided with external grooves in which wear rings 60 are mounted. Similar, packing gland members 22, 42 and 44 welded to the ends of barrel wall member 18 and sleeve wall members 34, 36, respectively, are provided with internal grooves in which wear rings 62, packing sets 64 and backup rings 66 are mounted.

Adjustable packing gland nuts 68, 70 and 72 are threadably mounted on the ends of packing gland members 22, 42 and 44, respectively.

The welded connections between bottom end members 20, 38, 40 and 56 and wall members 18, 34, 36 and 54 are made by an inertia welding process. Similarly, the welded connections between the gland members 22, 42, 44 and connecting member 54 and the wall members 18, 34, 36 and 54 are also made by an inertia welding process. In a typical inertia welding process the members are moved relative to each other by rotating one or both of the members and during such movement they are moved axially into abutting end-to-end engagement. The heat generated by the frictional forces at the abutting surfaces is sufficient to fuse the two members together. No external source of weld metal such as a welding electrode is required. The butt welded joints between the parts are shown in dotted lines and identified by reference numerials 74. The displaced metal which accumulates on opposite sides of the welded joints 74 is ground off where necessary to provide smooth mating surfaces.

The wall thickness of bottom end members 38, 40, 56 and gland members 12, 42, 44 is greater than the wall thickness of wall members 18, 34, 36, 54 thereby providing a stop shoulder 77 at each of the inertia butt welded connections. The ends of members 38, 40, 56, 22, 42, 44 are beveled slightly so that the faces of the stop shoulders 77 will extend at a slight angle with respect to planes extending at right angles to the horizontal axis of the cylinder assembly. In the preferred embodiment the angle referred to is approximately 10°.

The angled stop shoulders 77 at one end of the cylinder assembly will mate with the angled stop shoulders 77 at the other end of the cylinder assembly during operation of the cylinder. Such angled mating relationship provides relatively large sleeve stop contact areas and produces a self-aligning seating condition. This construction insures an effective and durable stop action between the telescoping members of the cylinder assembly as such members are moved from retracted to extended position in operation. In addition this construction eliminates the use of separately mounted, relatively loose mechanical stop rings or stop wire components which are typical of prior designs.

Reference is now made to the construction and function of inlet fitting 24 in combination with multiple inlet openings 25. As best shown in FIG. 2, openings 25 are spaced axially in the wall 18 of outer barrel assembly 10. The diameters of openings 25 are slightly less than the width of wear rings 60. This dimensional relationship eliminates any possibility of interference between the edges of a wear ring and the edges of an opening as the wear rings slide past the inlet openings when the cylinder assembly is energized from its retracted to its extended position. It will be appreciated that if the inlet passageway through the wall 18 were in the form of a single large opening (as in prior designs) undesirable interference between the wear rings and the inlet opening could occur, particularly if the split ends of a wear ring become positioned directly opposite the inlet opening.

Inlet fitting 24 is provided with a threaded side opening 75 for connection to a hydraulic fluid inlet line (not shown). Hydraulic fluid flows from inlet opening 75 into the outer barrel 18 through multiple inlet openings 25. Hydraulic fluid then flows from barrel 18 into sleeves 14 and 16 and then into rod assembly 16 through openings 76, 78 and 80 for sequential actuation of the hydraulic cylinder assembly. Openings 82 and 84 in the central portion of end caps 46 and 48 are provided to prevent sudden and violent relative movements of the cylinder sleeves should mis-staging occur in the operation of the cylinder assembly. Such mis-staging, for example, could occur should one of the gland nuts 68, 70 or 72 be tightened to an abnormally high degree of tightness.

The cylinder construction described above is particularly designed for ease of assembly and disassembly. To assemble the unit, sleeve 12 is inserted into barrel 10 through bottom end tube 20, sleeve 14 is inserted into sleeve 14 through bottom end tube 40. The assembly is completed by installing end caps 48, 46 and 26 in end tubes 40, 38 and 20, respectively, and installing packing gland nuts 68, 70 and 72 on the ends of packing gland members 22, 42 and 44, respectively.

Assume for example, the rod assembly 16 became damaged in use necessitating its removal from the cylinder for repair. This can be accomplished by simply removing end cap member 26 from barrel 18, end cap member 46 from sleeve 12, end cap member 48 from sleeve 14 and then pulling the rod 16 out through the open bottom end of the cylinder assembly. After the necessary repairs are made the rod 16 can be reassembled into the cylinder assembly by reversing the disassembly procedure described above. It will be appreciated that the rod 16 can be disassembled and reassembled as described above without disturbing the assembled position of sleeves 12, 14 in barrel 18. It is also noted that mounting pin 33 serves as a secondary backup for end cap 26 should a failure occur in retaining ring 28.

We claim:

1. A hydraulic cylinder assembly comprising:

an outer barrel having at least one internal sleeve and a center rod telescopically mounted therein, said outer barrel comprised of a tubular wall member having a bottom end tube welded to one end thereof and a packing gland tube welded to the other end thereof, said bottom end tube having an end cap removably mounted therein;

said internal sleeve comprised of a tubular wall member having an axial end of a bottom end tube butt welded to one axial end thereof and an axial end of a packing gland tube butt welded to the other axial end thereof, said axial end butt welds being the sole engagement of said internal sleeve with said bottom end tube and said packing gland tube, said bottom end tube having an end cap removably mounted therein;

said center rod comprised of a tubular wall member having a bottom end tube butt welded to one end thereof and a connection member fastened to the other end thereof;

adjustable packing gland nuts threadably mounted on said outer barrel and internal sleeve packing gland tubes;

externally extending stop shoulder means formed integrally with said end tubes of said internal sleeve and center rod, said end tubes having a wall thickness greater than the wall thickness of said tubular wall members to thereby provide said externally extending stop shoulder means, said externally extending stop shoulder means being directly at and radially about said end tube butt welds;

internally extending stop shoulder means formed integrally with said packing gland tubes of said outer barrel and internal sleeve;

wear ring means and packing gland means mounted between said telescopically arranged outer barrel, internal sleeve and center rod;

inlet fitting means mounted on said outer barrel through which hydraulic fluid can be introduced into said outer barrel;

internal passageway means inside said hydraulic cylinder assembly for facilitating flow of hydraulic fluid from said outer barrel into said internal sleeve and into said center rod;

said mating surfaces of said stop shoulder means on said end tubes and packing gland tubes being angled slightly with respect to planes extending at right angles to the axis of the hydraulic cylinder assembly to thereby provide a self-aligning seating action at the mating faces of said stop shoulder means.

2. The assembly of claim 1 in which said welded connections referred to in claim 1 are made by an inertia welding process.

3. The assembly of claim 1 in which said wear ring means is comprised of a plurality of wear ring members and in which said inlet fitting means includes a plurality of axially spaced openings in said outer barrel wall, said openings having a diameter less than the width of said wear rings.

4. A hydraulic cylinder assembly according to claim 1 in which said bottom end tube of said outer barrel has a pair of aligned bearing sleeves mounted therein and a connector pin mounted in said sleeves for securing the bottom end of the cylinder assembly to the particular device to which it is to be used.

* * * * *